US009488417B2

(12) United States Patent
Garret et al.

(10) Patent No.: US 9,488,417 B2
(45) Date of Patent: Nov. 8, 2016

(54) HEAT EXCHANGER

(75) Inventors: Paul Garret, Veneux les Sablons (FR); Eric Piniarski, Bazancourt (FR); Claire Piniarski, legal representative, Bazancourt (FR)

(73) Assignee: VALEO SYTEMES THERMIQUES, Le Mesnil-Saint-Denis (FR)

( * ) Notice: Subject to any disclaimer, the term of this patent is extended or adjusted under 35 U.S.C. 154(b) by 432 days.

(21) Appl. No.: 13/516,787

(22) PCT Filed: Dec. 2, 2010 (Under 37 CFR 1.47)

(86) PCT No.: PCT/EP2010/068769
§ 371 (c)(1), (2), (4) Date: Feb. 1, 2013

(87) PCT Pub. No.: WO2011/073038
PCT Pub. Date: Jun. 23, 2011

(65) Prior Publication Data
US 2013/0146267 A1 Jun. 13, 2013

(30) Foreign Application Priority Data
Dec. 18, 2009 (FR) ..... 09 06150

(51) Int. Cl.
*F28D 21/00* (2006.01)
*F28F 9/02* (2006.01)
*F28D 7/16* (2006.01)

(52) U.S. Cl.
CPC ..... *F28D 7/1653* (2013.01); *F28D 7/1684* (2013.01); *F28F 9/0219* (2013.01);
(Continued)

(58) Field of Classification Search
CPC ..... F28F 9/00; F28F 9/001; F28F 9/002; F28F 9/0075; F28F 9/0219; F28F 2275/04; F28F 2275/122; F28D 7/1653; F28D 7/1684; F28D 21/0003
USPC ..... 165/173, 148, 149, 158
See application file for complete search history.

(56) References Cited

U.S. PATENT DOCUMENTS 824,808 A * 7/1906 Pannier ..... 165/158
872,129 A * 11/1907 Heffley ..... 165/158
(Continued)

FOREIGN PATENT DOCUMENTS

DE 195 15 530 A1 10/1996
DE 10 2005 054043 A1 5/2007
(Continued)

OTHER PUBLICATIONS

International Search Report with translation, issued in PCT/EP2010/068769, mailed May 3, 2011 (6 pages).
(Continued)

*Primary Examiner* — Tho V Duong
(74) *Attorney, Agent, or Firm* — Howard & Howard Attorneys PLLC

(57) ABSTRACT

The invention relates to a heat exchanger including exchange components and fluid flow components (2, 2', 3), at least one fluid collecting tank (11, 11') into which the exchange components open out (2, 2', 3), and a housing (4) for accommodating the exchange components (2, 2', 3). The exchanger is characterized in that it includes a flange (5) for fixing the collecting tank (11, 11') on the housing (4), the flange comprising a groove (G1) for fixing the housing (4) and a groove (G2) for fixing the collecting tank (11), the grooves (G1, G2) having a common wall (19). Thanks to the invention, a very compact heat exchanger is obtained.

9 Claims, 6 Drawing Sheets

(52) U.S. Cl.
CPC ..... *F28F9/0226* (2013.01); *F28D 21/0003* (2013.01); *F28F 2275/04* (2013.01); *F28F 2275/122* (2013.01)

(56) References Cited

U.S. PATENT DOCUMENTS

| | | | | |
|---|---|---|---|---|
| 3,939,908 | A * | 2/1976 | Chartet | 165/149 |
| 3,948,315 | A | 4/1976 | Powell | |
| 4,351,390 | A * | 9/1982 | Argyle et al. | 165/149 |
| 4,848,448 | A * | 7/1989 | Kaarre | 165/158 |
| 6,006,430 | A * | 12/1999 | Fukuoka et al. | 29/890.03 |
| 6,595,274 | B2 * | 7/2003 | Hayashi et al. | 165/158 |
| 7,007,745 | B2 | 3/2006 | Iwasaki et al. | |
| 8,881,796 | B2 * | 11/2014 | Hemminger et al. | 165/158 |
| 2006/0272801 | A1 * | 12/2006 | Ikawa | 165/149 |
| 2009/0200003 | A1 | 8/2009 | Digele | |
| 2013/0192803 | A1 | 8/2013 | Garret et al. | |

FOREIGN PATENT DOCUMENTS

| | | | |
|---|---|---|---|
| EP | 2 031 338 | A2 | 3/2009 |
| JP | 60186695 | A * | 9/1985 |
| JP | 03225197 | A * | 10/1991 |
| JP | 2002-168586 | A | 6/2002 |
| JP | 2007-77839 | A | 3/2007 |
| WO | 02/077559 | A1 | 10/2002 |
| WO | 2008/125309 | A2 | 10/2008 |

OTHER PUBLICATIONS

International Search Report with translation, issued in PCT/EP2010/068768, mailed Apr. 29, 2011 (6 pages).

* cited by examiner

HEAT EXCHANGER

The invention relates to a heat exchanger.

A heat exchanger, for example used in the car industry and more exactly in a heat combustion engine in a motor vehicle, includes heat exchange components and fluid flow components in which the fluids circulate exchanging heat between them. The heat exchange components can comprise, for example, tubes, plates, fins and flow agitators, etc. Numerous structural configurations are conceivable. For example, the exchanger can comprise a core of tubes arranged in parallel one with respect to the other in one or several rows which are also parallel, said tubes being designed to convey a first fluid, whilst a second fluid flows between the tubes and exchanges heat with the first fluid. Numerous fluid associations can be conceived, whether they be liquids and/or gases.

The exchanger includes a housing for receiving the tubes, said housing including a plurality of walls forming the volume in which the tubes are received. It is generally open at its two ends so that the tubes can be connected to the fluid collection or distribution tanks also called collecting tanks: one input collecting tank and one output collecting tank. The first fluid flows in the tubes from the input collecting tank toward the output collecting tank. The second fluid flows around the tubes, from an input pipe toward an output pipe, and exchanges heat with the first fluid.

The exchanger generally also includes two collecting plates for holding the tubes, the fluid collecting tanks being mounted on the collecting plates. The tubes pass through openings arranged in the collecting plates and open out into the fluid collecting tanks.

Generally, the collecting plates are fixed to the housing and the collecting tanks are fixed to the collecting plates, for example by crimping. To this end, each collecting plate includes means allowing an edge of the collecting tank with which it is associated to be crimped thereto. Such a fixing method for the tank is known, for example, from document WO 2008/125309 or also from document EP 2,031,338 in which the collecting plate is in two parts which are joined mechanically.

In certain engines, there are constraints on the available space in the area in which the exchanger has to be mounted; consequently it is necessary to produce exchangers respecting these constraints. These constraints can mean, for example, that relatively flat exchangers have to be produced. To this end, flattened tubes are provided but with a sufficiently large cross section to present the fluid with a passage cross section adapted to the desired flow. Such tubes have a streamlined cross section; typically, they can have a rectangular cross section with the dimensions 100 mm×7 mm. Moreover, in applications where, for example, water, which is a good heat-conveying fluid, circulates between the tubes, it is preferable for the spacing between successive tubes to be small, for example equal to 2 or 3 mm or less.

Consequently, it is necessary to manufacture the collecting plates with elongated openings separated by small width walls, said width corresponding to the spacing between successive tubes. In this case, the walls separating the openings have very great cross sectional slenderness, that is to say that they are very elongated in one direction but slim in the two other directions. Consequently, the question of how they are manufactured arises. It is known that for the manufacture of collecting plates, punching processes with so-called "straight edge blanking", allow inter-opening walls thinner than the thickness of the plate to be realized from a relatively thick plate; for example, openings which are 60 mm in length can be formed in a plate which is 4 mm thick with inter-opening walls with a width approximately equal to 2.6 mm. Nevertheless, when forming a collecting plate with openings which are 100 mm in length and inter-opening walls of 2 mm, it is not possible to implement a punching process with straight edge blanking. Consequently, it is advisable to use a classic chasing process; in this case, the thickness of the plate must be less than the width of the inter-tube walls and, for the above case, a plate with a very thin thickness of between 0.8 mm and 1 mm is recommended. Now, if the collecting tank has to be crimped by the collecting plate, this latter must have sufficient mechanical strength to fulfill this function. Consequently, a dilemma is faced as if the thickness of the collecting plate is increased (by taking it for example to 1.5 or 2 mm) it becomes impossible to implement a classic chasing process. It thus seems difficult to be able to provide a large cross sectional slenderness for the tubes since it is necessary to ensure a sufficient thickness for the collecting plate.

It is thus apparent that the question of compactness of a heat exchanger is particularly restrictive, the subject of numerous developments and a source of various problems. It is for these reasons that the invention aims to provide a more compact architecture for a heat exchanger.

It is noted that the invention arises from the resolution of a particularly sensitive problem in the case of a collecting plate with openings with a large cross sectional slenderness; however, the invention is not limited to this single application, the invention also providing advantages in its application to collecting plates with openings with a more reasonable cross sectional slenderness.

It is thus that the invention relates to a heat exchanger including exchange components and fluid flow components, at least one fluid collecting tank into which the exchange components open out and a housing for accommodating the exchange components, characterized in that said heat exchanger includes a flange for fixing the collecting tank to the housing, the flange comprising a groove (G1) for fixing the housing (4) and a groove (G2) for fixing the collecting tank (11), the grooves (G1, G2) having a common wall (19).

The grooves make it possible to receive or accommodate walls of the housing and of the collecting tank. The use of such a fixing flange provided with two grooves having a common wall makes the exchanger very compact. Indeed, the collecting box and the housing are fixed together in a compact manner without, however, being directly fixed together, thereby ensuring the robustness of the assembly and enabling in particular good transmission of stresses.

Preferably, the grooves are opposed, that is to say that they are oriented in opposite directions. More precisely, since the exchanger extends overall along an axis which is preferably the overall flow axis of the fluids within said exchanger, each groove has an end wall that is approximately transverse to said direction and a transverse peripheral opening, the openings being turned in two directions opposing said direction.

According to one embodiment, the exchanger has at least one collecting plate for holding the exchange components.

According to one embodiment in this case, the collecting plate and the fixing flange are formed from one and the same part.

According to another embodiment in this case, the fixing flange and the collecting plate are distinct parts fixed to the housing independently of each other. In this way the functions of holding the tubes and holding the collecting tank have been decoupled: two distinct parts fulfill these functions, these parts being fixed to the housing independently of each other, that is to say without direct transmission of forces between each other. In particular, it is thus possible to provide a collecting plate with a small thickness (typically 0.8 mm) with openings with great cross sectional slenderness; in this way tubes with a streamlined cross section can be formed and therefore a flattened exchanger which takes up little space. The function of holding the collecting tank is ensured by the flange, in an independent manner. An exchanger which is all the more compact is thus obtained.

According to one embodiment, the flange and/or the collecting plate is fixed directly to the housing. In this way, the compactness of the exchanger is further increased.

According to one embodiment, the flange and the collecting plate do not contact each other. In this way, the lack of direct transmission of stresses between said two parts, which are not only not fixed to each other but also do not contact each other, is ensured in an even better manner.

According to one embodiment, the exchange components include the tubes within which a first fluid (for example a gas) is flow-connected to the tank and around which flows a second fluid (for example a liquid), the collecting plate fulfils a sealing function between the first fluid and the second fluid and the flange fulfils a sealing function between the first fluid and the outside of the exchanger.

According to one embodiment, the collecting tank and the flange are crimped to each other.

According to one embodiment, the flange is brazed to the housing. Such a fixing method is sturdy and not expensive.

According to one embodiment in this case, the housing includes at least one locating lug designed to be accommodated in an opening in the flange to hold this latter on the housing whilst both parts are being brazed.

Preferably in this case, the opening is arranged in the bottom of the groove for fixing the housing.

According to one embodiment, the locating lug is designed to be crimped against the fixing wall to hold it in the opening.

According to one embodiment, the locating lug is designed to be deformable to hold it in the opening.

According to one embodiment, the collecting plate is brazed to the housing.

According to one embodiment, the collecting plate includes a skirt with an area along which it is brazed to the housing. In this way, there is a large contact surface, which ensures the parts are well brazed.

The overall cross sectional shape of the pipes is preferably rectangular, the ratio of length to width of which is preferably in excess of 5.

The invention applies particularly well to an air-water exchanger, for example a water cooler for recirculated exhaust gases or a charge air cooler for a heat combustion engine of a motor vehicle The invention will be better understood by way of the following description of the preferred embodiment of the exchanger of the invention, with reference to the sets of accompanying drawings, in which.

Figure 1:
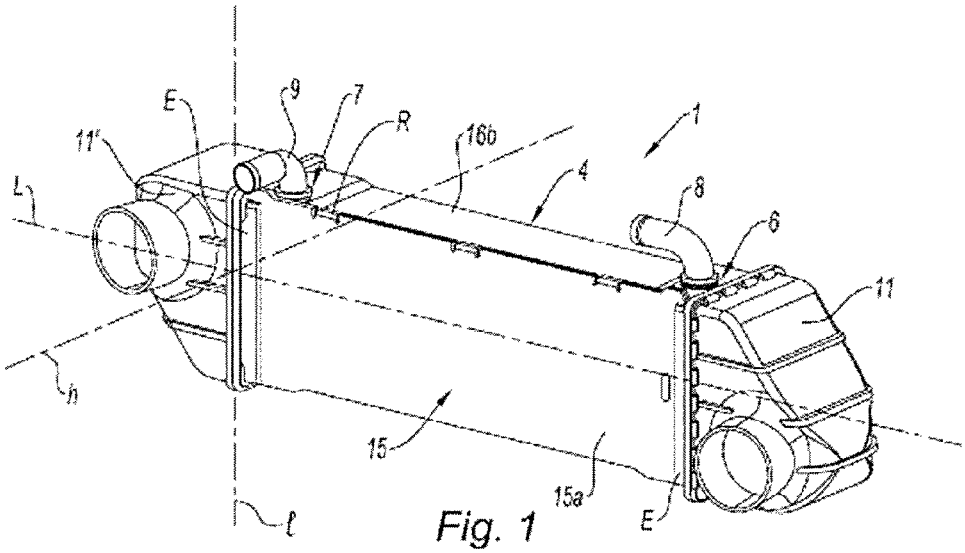
FIG. 1 shows a perspective view of a first embodiment of the exchanger of the invention, with the fluid collecting tanks fixed to its flanges.
Figure 2:
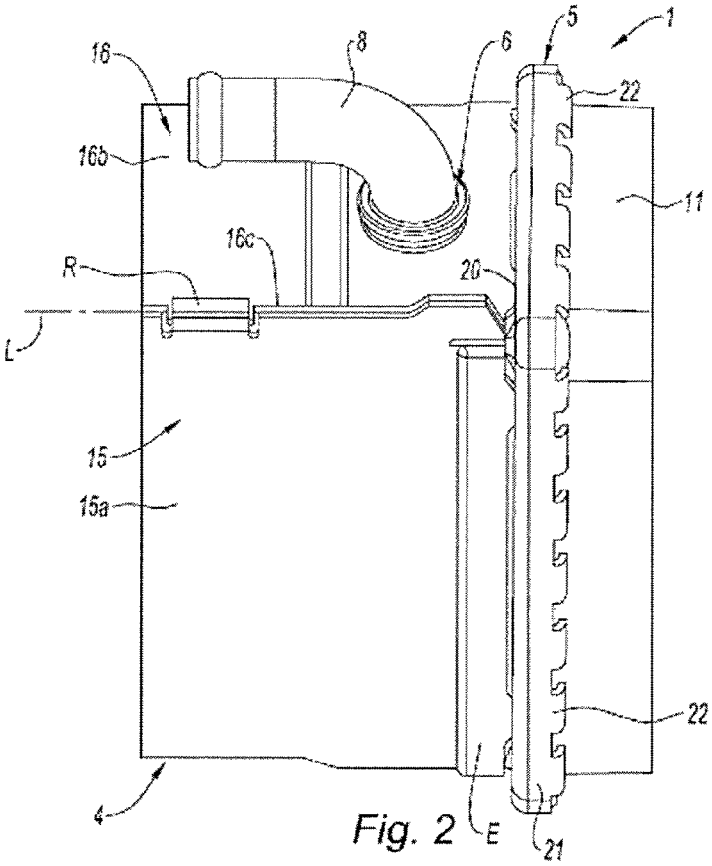
FIG. 2 shows a detail (from above) in FIG. 1.

With reference to the figures and more particularly to FIGS. 1 to 6, a heat exchanger 1 according to a first embodiment includes heat exchanging components 2, 2', 3, a housing 4 for receiving or accommodating said components 2, 2', 3, an air inlet collecting tank 11 and an air outlet collecting tank 11'. The housing 4 includes the openings 6, 7 for connecting to the pipes 8, 9 for the flow of water, in this particular case an inlet pipe 9 and an outlet pipe 8, connected to a water circuit in which the exchanger 1 is mounted. In the embodiment described, the different components of the exchanger 1 are brazed to each other, except for the tanks 11, 11' which are crimped; such exchangers with their components brazed or crimped are well known by the person skilled in the art as far as their general characteristics are concerned.

The exchanger 1 describes a so-called "air-water" exchanger, that is to say an exchanger in which the fluids which exchange heat are air and water. It is, for example, a water cooler for so-called "recirculated" exhaust gases of a heat combustion engine for an automotive vehicle or perhaps a charge-air cooler for such an engine; the water is preferably so-called <<low temperature>> water from the cooling circuit of said engine; it is typically glycolized water.

With reference to FIG. 1, the overall form of the exchanger 1 is a parallelepiped. Conventionally and to simplify its description, the direction L is defined by the length of the exchanger 1, which is its largest dimension, and the direction in which the fluids flow, the direction 1 by the width of the exchanger 1 and the direction h by its height (or thickness). Subsequently, the direction of said dimensions will be mixed up with their value; in other words, L, l or h will indicate respectively equally well the length, the width and the height of the exchanger 1 or the direction of the length, the direction of the width and the direction of the height of the exchanger 1. Moreover, in the figures, a Cartesian reference (L, l, h) is formed on the basis of these perpendicular directions together. Furthermore, the ideas of external (or outside) and internal (or inside) used in the description refer to the relative positions of the components compared to the outside or inside of the exchanger 1.

Figure 3:
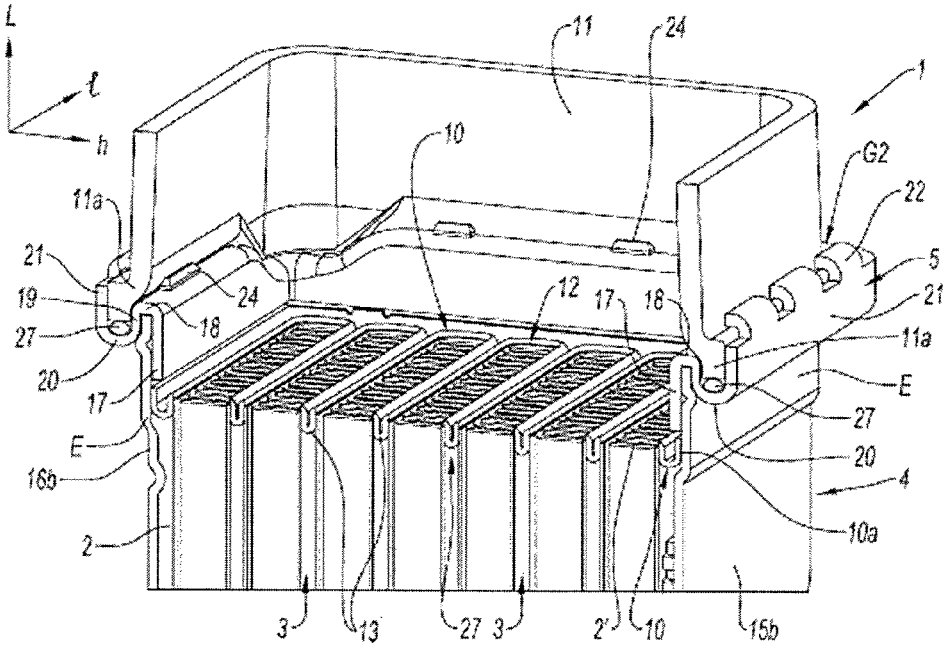
FIG. 3 shows a perspective sectional view in the plane of the height and the length of the exchanger in FIG. 1.

With reference to FIG. 3, the exchange components include the flattened tubes 2 for the flow of air. Their large dimension (which is the overall direction of the flow of air within them) is parallel to the direction of the length L of the exchanger 1 and their cross section transversally with respect to this length L is rectangular in shape; the rectangle, the cross section of each tube 2 being in this form, has a dimension parallel to the width 1 of the exchanger 1 and a dimension parallel to the height h of the exchanger 1. Each tube 2 has a length appreciably equal to the length L of the exchanger 1 and a width appreciably equal to the width 1 of the exchanger 1; its dimension parallel to the height h of the exchanger 1 (this is its thickness) is less than the height of the exchanger 1 and, in this particular case, is relatively small, which gives the tubes 2 their flattened total. By way of example, the thickness of the tubes 2 can be equal to approximately 7 or 8 mm for each tube 2, the width 1 of the tubes 2 being equal to approximately 100 mm. Moreover, the inter-tube spaces (that is to say the ducts 3 for the flow of water) can, for example, be of a dimension (parallel to the height h of the exchanger 1) that is less than 3 mm, for example is appreciably equal to 2 mm. The exchanger 1 is compact in this way. The tubes 2 are assembled in parallel with each other, all the tubes 2 forming a stack in the direction of the height h of the exchanger 1; this is also referred to as a core of tubes; the dimension of the entire core in parallel with the height h of the exchanger 1 is appreciably equal to the height h of the exchanger 1. The tubes 2 are each assembled respectively in parallel with one another, and allow the circulation of air within them, overall in the direction of the length L of the exchanger.

Fins 2' for agitating the air flow are mounted in the tubes 2 allowing the heat exchanges between the air and the water to be facilitated through the walls of the tubes 2. Said fins 2' are well known to the person skilled in the art and it is not necessary to describe them in detail; in this case they have an undulating form and their cross section, when seen in an end view in the axis of the length L of the exchanger 1, is in the form of a coil between the walls of each tube 2.

The water flow agitators (not shown) are mounted in the water flow ducts 3 arranged between the tubes 2, said flow preferably being against the current, that is to say in the opposite direction to the direction of flow of the air. The agitators are in the form of plates which extend appreciably over the entire lateral area of the tubes 2 (the lateral area is the area of the tubes 2 defined by the dimensions parallel to the length L and to the width 1 of the exchanger 1) and in all the space between successive tubes 2 to which they are brazed; agitators are also provided between the end tubes 2 and the walls of the housing 4. The shape of the agitators creates the turbulence in the flow of water passing across them in order to promote the heat exchanges, in a known manner.

As alluded to further above, the exchanger 1 includes, at each of its ends (in the dimension of its length L), an air collecting tank 11, 11'. On the right-hand side (in FIG. 1), this is the air inlet collecting tank 11 and, on the left-hand side, the air outlet collecting tank 11'. The ends of the air circulation tubes 2 are connected to the air collecting tanks 11, 11', the inside volume of the tubes 2 thus being flow-connected to the inside volume of the collecting tanks 11, 11'; in other words, the tubes 2 open out into the collecting tanks 11, 11'. The collecting tanks 11, 11' are connected to the pipes of an air circuit in which the exchanger 1 is mounted. The air is introduced into the tubes 2 by means of the air inlet collecting tank 11 and is collected leaving the tubes 2 by the air outlet collecting tank 11'.

The structure of the exchanger will be described in more detail by its connection to the inlet tank 11. The description given applies equally to the exchanger at its output tank 11'. The input 11 and output tanks 11', in this particular case, are similar and are mounted symmetrically; obviously, according to another embodiment, they can be different.

The exchanger 1 includes at its end a collecting plate 10, the function of which is to hold the tubes 2 in position, to guide the flow of air between the inside volume of the collecting tank 11 and the tubes 2 and to prevent water flowing toward the inside volume of the collecting tank 11, while preventing flows of air and water converging; in other words, the collecting plate 10 ensures the seal between the air and the water. The person skilled in the art often refers to the collecting plate 10 using the term collector 10 and it will be designated as such below.

The collector 10 is fixed to the housing 4, in this particular case by means of brazing, at an area of a peripheral edge. More precisely in this particular case, the collector 10 includes a peripheral skirt **10*a* having a lateral area along which the collector 10 is brazed to the housing 4; this allows for simpler positioning between said two parts before they are brazed but also for a better hold between the two since the contact area (and therefore the brazing area) is larger than if the collector 10** were brazed along an edge.

The peripheral skirt **10*a* is formed by the edge of the collector 10 which is bent over, in this particular case along its entire periphery. The skirt 10*a* therefore extends perpendicularly with respect to the overall plane of the plate forming the collector 10, in parallel, therefore, with the direction of the length L of the exchanger 1. The skirt 10*a* can be bent over in one direction (as in FIG. 3) or in the other (as in FIG. 12), in other words toward the outside or toward the inside of the exchanger 1, respectively; the bending side depends notably on the space available and on the spacing between the collector 10 and the flange 5** described below.

Figure 5:
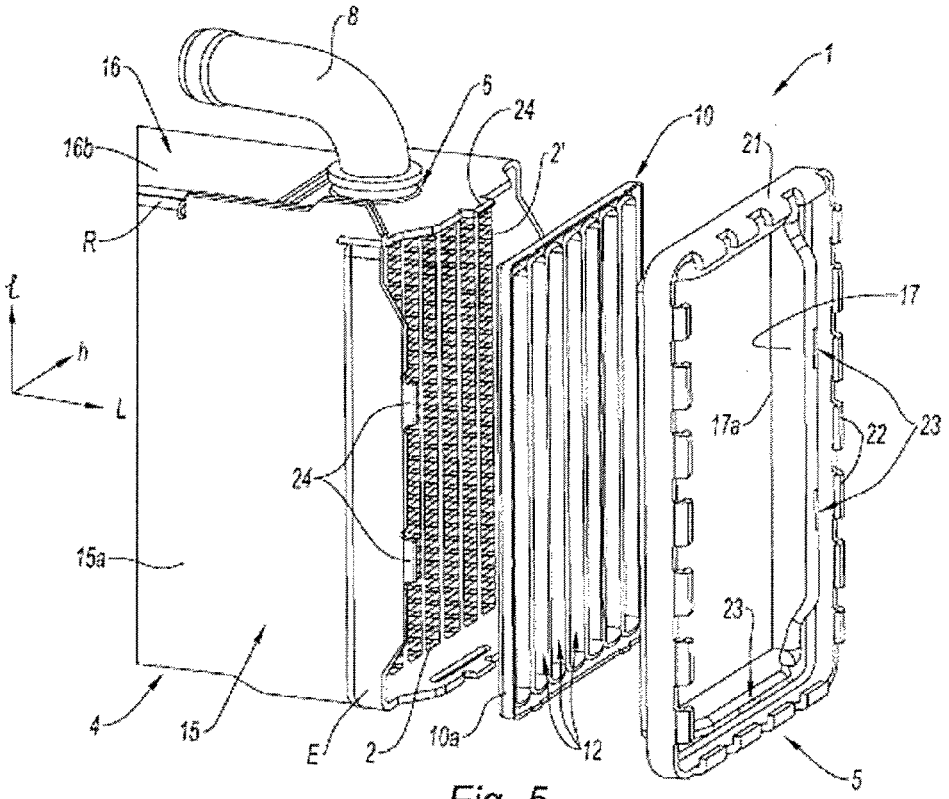
FIG. 5 shows a partially exploded perspective view of the exchanger in FIG. 1, without a collecting tank.
Figure 6:
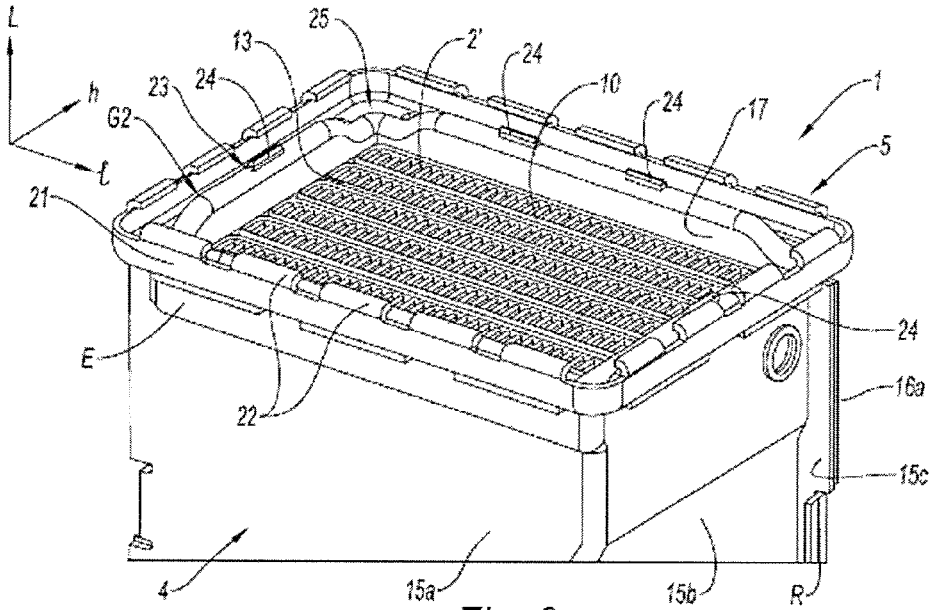
FIG. 6 shows a perspective end view, from below, of the exchanger in FIG. 1, without a collecting tank.

With reference to FIG. 5, the collector 10 is in the form of a plate mounted transversely with respect to the length L of the exchanger 1 in order to receive the ends of the tubes 2. The collector 10 is perforated by a plurality of openings 12, each opening 12 being associated with a tube 2. The form of each opening 12 corresponds to the cross section of a tube 2 and is edged by the walls 13 or collars 13 or rims 13 containing the end of the tubes 2 and holding these latter in position; the collars, moreover, fulfill a function of stiffening the collector 10. Said collars 13 extend overall perpendicularly with respect to the overall plane of the plate forming the collector 10, therefore in parallel to the direction of the length L of the exchanger 1, the end 13' projecting from said collars 13 being directed toward the inside of the exchanger 1; in this way, the collars 13 extend from the collector 10, around the tubes 2, fitting tightly around the ends of said tubes. The ends of the tubes 2 are slipped into said collars 13, forming a slide in order to fit tightly around them; each collar 13 forms a contact area with the area of the end of the tube 2 which is associated therewith, allowing them to be brazed to each other. The tubes 2, brazed in this way to the collars 13 edging the openings 12 of the collector 10, are fixed in position. The ends of the tubes 2 are thus separated from each other by the collars 13, the separating spaces between the successive tubes 2 define the ducts 3 for the flow of water. As the collars 13 are brazed to the ends of the tubes 2 and, in a transversal manner, (compared to the direction of the length L of the exchanger 1) fill all the space between them, said collars 13 prevent the water from flowing into the volume of the collecting tank 11; furthermore, said collars 13 also prevent the water from flowing into the tubes 2. This type of collector 10 is well known to the person skilled in the art and it is not necessary to describe it in any more detail.

In the embodiment shown, the housing 4 includes two walls 15, 16 being formed into an L. In other words, each wall 15, 16 has a cross section (compared with the direction of the length L of the exchanger 1) in the shape of an L. Each wall 15, 16 is formed into an L by bending around an edge to form two vanes (**15*a*, 15*b*), (16*a*, 16*b*) perpendicular with respect to each other. The idea of the walls 15, 16** in the shape of an L is their simplicity of manufacture and storage in view of the manufacture of the exchangers (storage being possible simply by assembling the walls together one on top of another).

More precisely, each wall 15, 16, in this case, includes a large vane 15*a*, 16*a* and a small vane 15*b*, 16*b*. The large vane 15*a*, 16*a* is in the form of a rectangular plate with dimensions appreciably equal to the length L of the exchanger 1 and to its width 1, whilst the small vane 15*b*, 16*b* is in the form of a rectangular plate with dimensions appreciably equal to the length L of the exchanger 1 and to its height h. The concepts of large and small vanes are introduced here to allow each of the vanes (15*a*, 15*b*), (16*a*, 16*b*) of each wall 15, 16 to be designated in a distinct manner The water inlet 9 and outlet pipes 8 into and out of the exchanger 1 are connected here to a same side of the exchanger 1, in this particular case to the small vane 16*b* of the second wall 16.

The walls 15, 16 of the housing 4 are fixed to each other around the exchange components 2, 2', 3; in this particular case, they are brazed. To this end, each wall 15, 16 includes, at the free end of its small vane 15*b*, 16*b*, a raised edge 15*c*, 16*c*, which is an edge 15*c*, 16*c* to be fixed to the large vane 16*a*, 15*a* of the other wall 16, 15. Said raised edge 15*c*, 16*c* extends perpendicularly with respect to the small vane 15*b*, 16*b*, from an edge of the bend by means of which it is connected thereto. Crimping lugs R are arranged to ensure the connection between the raised edges 15*c*, 16*c* and the corresponding large vanes 16*a*, 15*a*. Brazing allows the contact areas to be locked together and held one against the other.

Once the walls 15, 16 have been fixed, the vanes (15*a*, 15*b*), (16*a*, 16*b*) of the walls 15, 16 formed into an L form the four lateral sides of the exchanger 1 (lateral sides are referred to with regard to the direction of its length L).

It is remembered here that in the embodiment described, the collector 10 is fixed to the housing 4 by means of brazing. More precisely, the outside area of its peripheral skirt 10*a* is brazed to the internal area of the vanes (15*a*, 15*b*), (16*a*, 16*b*) of the walls 15, 16.

Figure 7:
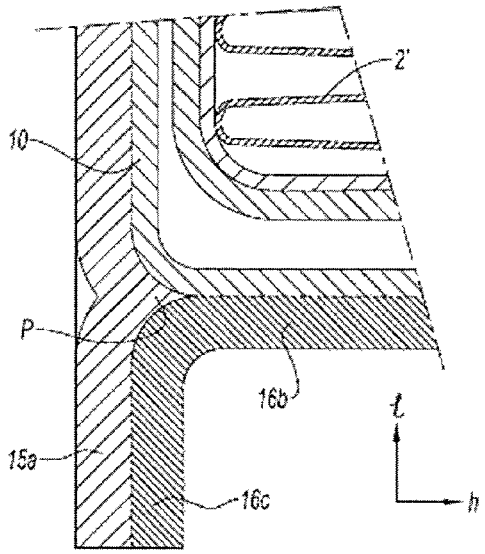
FIG. 7 shows a cross section of a corner of the exchanger in FIG. 1.
Figure 8:
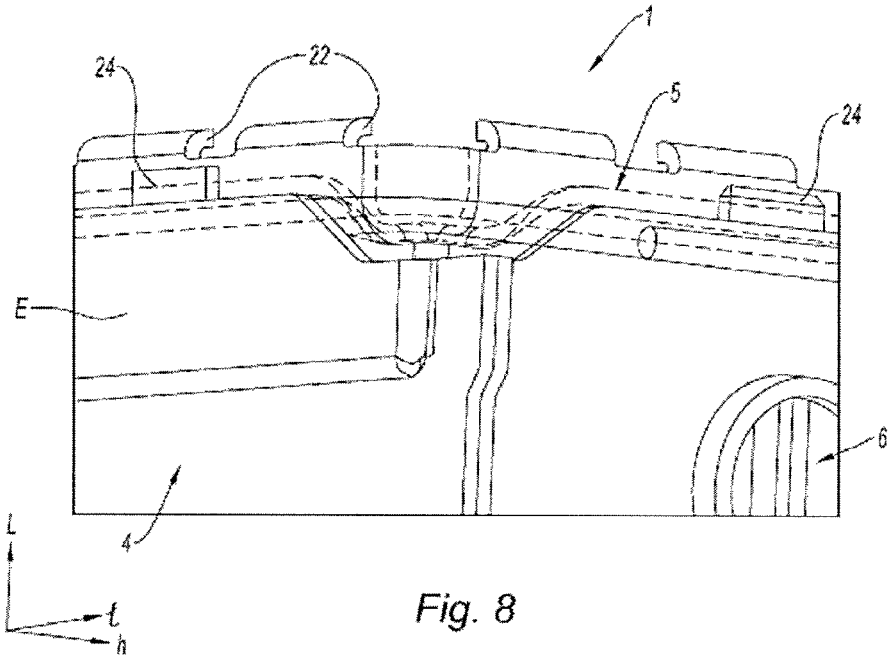
FIG. 8 shows a perspective view and partially from the back of a corner of the exchanger in FIG. 1.

One particular characteristic of the walls 15, 16 will be described now with reference to FIG. 7. Close to the contact zone between the raised edge 15*c*, 16*c* of the small vane 15*b*, 16*b* of each wall 5, 16 and the large vane 16*a*, 15*a* of the other wall 16, 15, there is a zone where there is a clearance with the rounded corner of the collector 10 (said two clearances diagonally opposite on the exchanger 1 are shown by the same reference J). Because of the existence of said clearances J, there is a risk of water leaking there. This is the reason why each wall 15, 16 includes a sealing portion P close to each of the free corners of its large vane 15*a*, 16*a*. Each sealing portion P is in the form of a portion protruding out of the inside area of the large vane 15*a*, 16*a* of the wall 15, 16, in the direction of the tubes 2; said protruding portion P is in the form of a corner or a fin. Such a protruding portion P can either be chased on the wall 15, 16 subsequently to its manufacture, or can be directly formed during the manufacture of the wall 15, 16. Once the contact areas have been brazed, the seal is thus assured at said sealing portion P.

It is noted that the walls 15, 16 each include two widenings E, respectively, in the direction of the height h of the exchanger 1, arranged close to each end of its large vane 15*a*, 16*a*. Said widenings E are formed here by chasing the wall 15, 16. They are provided as the dimensions of the collector 10 are greater, in the direction of the height h of the exchanger 1, than the dimension of the small vanes 15*b*, 16*b* of the walls 15, 16 in an L; these are therefore the widenings E (or stampings E) for accommodating the collector 10. Said stampings E have an additional advantage: insofar as they accommodate the collectors 10 in the direction of the height h of the exchanger 1, they form a stop in the dimension of the length L of the exchanger 1; thus, they form axial holding means (in this direction L) for the collectors 10 and therefore for all the exchange components 2, 2' whilst all the components of the exchanger 1 are being brazed.

Furthermore, the exchanger 1 includes a flange 5 for fixing the collecting tank 11 to the housing 4. Said flange 5 is brought onto the housing 4. It is fixed (in this particular case by means of brazing) to the end of the housing 4, along the periphery of said housing; this is therefore a peripheral flange 5, with an overall rectangular form, in this particular case formed from one single part. It is fixed to the housing 4 independently of the collector 10 and is not fixed to this latter; in other words, the exchanger 1 does not include any means for fixing the flange 5 to the collector 10.

The flange 5 includes an internal longitudinal wall 17 (in the direction of the length L) which extends along its entire periphery; said internal longitudinal wall 17 is arranged in order to extend from the internal side of the walls 15*a*, 15*b*, 16*a*, 16*b* of the housing 4 and to be brazed to them.

The internal longitudinal wall 17 is bent out toward the outside and in the direction of the exchanger 1, thus forming an internal transverse wall 18 and an intermediate longitudinal wall 19 providing, with the internal longitudinal wall 17, a peripheral groove G1 for accommodating the walls 15*a*, 15*b*, 16*a*, 16*b* of the housing 4, fulfilling a function of fixing the housing 4 in this way. The internal transverse wall 18 forms a stop for the end of the walls 15*a*, 15*b*, 16*a*, 16*b* of the housing 4.

The intermediate longitudinal wall 19 is bent out toward the outside and in the opposite direction of the bend forming the peripheral groove G1, thus forming an external transverse wall 20 and an external longitudinal wall 21 providing, with the intermediate longitudinal wall 19, a peripheral groove G2 for accommodating a side edge 11*a* of the end of the collecting tank 11, fulfilling a function of fixing the collecting tank 11 in this way; this is the end of the tank 11 by means of which it is fixed to the flange 5; the side edge 11*a* of the tank 11 will be called the fixing edge 11*a*.

Thus, the flange includes two peripheral grooves G1, G2 formed by the walls 17, 18, 19, 20, 21 of the flange 5, said grooves G1, G2 including a common wall 19. Each groove G1, G2 is provided for holding a part, in this particular case for holding the housing 4 and the collecting tank 11, respectively. More precisely, the housing 4 and the collecting tank 11 are each arranged so that their longitudinal end walls (in the direction of the length L of the exchanger 1) are inserted longitudinally into a peripheral groove G1, G2, by means of the transverse opening in said groove G1, G2. The grooves G1, G2 are oriented in opposite directions, that is to say that their openings are turned in two opposite directions in the direction of the length L of the exchanger 1. On account of their structure with a common wall 19, they provide the exchanger 1 with great compactness and a high level of hold for the parts 4, 11, whether this be in view of their brazing (for the housing 4) or in view of their crimping (for the collecting tank 11).

In the extension of the external longitudinal wall 21, the flange 5 includes lugs 22 for crimping the tank 11 to the flange 5. Said lugs 22 are arranged so as to be hooked (bent over) on the fixing edge 11*a*. The crimping lugs 22 are shown bent over (that is to say in the crimping position) in all the figures. The tank 11 is therefore crimped to the flange 5.

Figure 4:
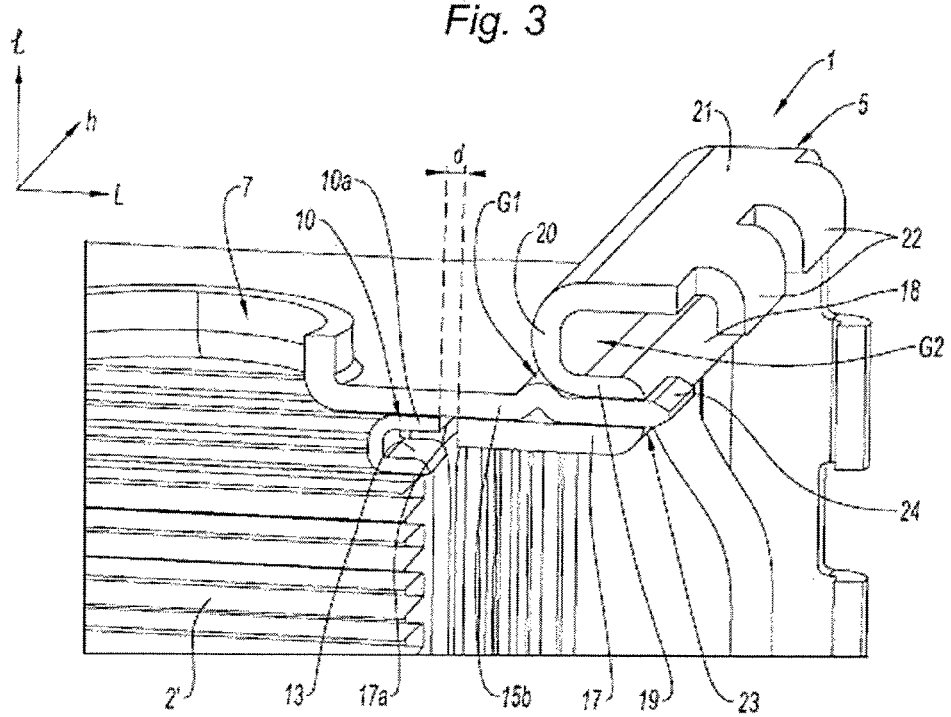
FIG. 4 shows a perspective sectional view in the plane of the length and the width of the exchanger in FIG. 1, without a collecting tank.

With reference in particular to FIG. 4, the exchanger 1, in this particular case, is arranged so that the collector 10 is fixed to the housing 4 at a spacing d from the flange 5 and more precisely from the free end 17*a* of its internal longitudinal wall 17.

The holding of the tubes 2 is ensured by the collector 10 and the holding of the collecting tank 11 is ensured (by crimping) by the flange 5, itself brazed to the housing 4, the collector 10 and the flange 5 both being brazed to the housing 4 but independently of one another; in this particular case, they do not even contact one another. In this way, the stresses to which the flange 5 is subjected on account of its function of holding the collecting tank 11 are not transmitted directly to the collector 11 which is connected to the housing 4 and to the tubes 2.

Insofar as the stresses applied to the flange 5 are not transmitted to the collector 11, this latter can be formed so as to be able to receive the tubes 2 with a streamlined cross section and separated from each other by a small spacing. In particular, it is possible to form the collector 11 by means of a traditional chasing process on plate with a very thin thickness; in such a process, the collars 13 of the collector 11 are stamped then their bottom is punched in order to form the openings, in a known manner. By way of example, as the plate allowing the collector 10 to be formed has a thickness of approximately 1 mm, a collector 10 can be formed with openings 12 of 100 mm by 7 or 8 mm approximately, with an inter-tube space of 2 to 3 mm. The space occupied (dimension parallel to the direction of the length L of the exchanger 1) by the collars 13 can be appreciably equal to 4 mm; in this way, by removing the thickness of the straps 14 (1 mm), the collars 13 have a useful area for the application of the end of the tubes 2 and for brazing thereto of approximately 3 mm.

Furthermore, as the collector 10 is brazed directly to the housing 4, the radius of its corners is relatively large and the collector 10 is simpler to manufacture, which is of interest as, on account of the thickness of the collector 10, it is not always easy to form it correctly.

One additional advantage is that, industrially, the invention can be implemented with collectors of the prior art, which are thin but not very strong, simply by adding a flange 5.

The openings 23 for receiving the locating lugs 24 protruding longitudinally out of the vanes 15*a*, 15*b*, 16*a*, 16*b* of the housing 4 are arranged in the internal transverse wall 18 of the flange 5 (that is to say in the bottom of the groove G1). Each lug 24 extends in the extension of the vane 15*a*, 15*b*, 16*a*, 16*b* supporting it; one vane 15*a*, 15*b*, 16*a*, 16*b* can include one or several lugs 24; all the vanes 15*a*, 15*b*, 16*a*, 16*b* or just some of them can include one or several lugs 24. In this particular case, the exchanger 1 includes one locating lug 24 located in the middle of the end of each small vane 15*a*, 16*a* of the housing 4 and two locating lugs 24 located at the end of each large vane 15*b*, 16*b* of the housing 4.

The locating lugs 24 are arranged so as to be able to be bent over or deformed so as to hold the flange 5 in position in relation to the housing 4 by means of crimping. The function of their deformation is also to ensure they are brazed perfectly to the inside areas of the openings 23 into which they are inserted so as to take up the mounting clearance with said areas and to avoid any air escaping here, in other words to ensure the sealing of the openings 23. To this end, the lugs 24 can be bent over against the internal transverse wall 18, for example by resting on this latter itself abutting against the end edge of the vanes 15*a*, 15*b*, 16*a*, 16*b* of the housing 4. They can also simply be deformed rather than crimped, inasmuch as simple deformation would preclude any movement in relation to the flange 5.

The function of said lugs 24 is to allow the positioning and the holding of the flange 5 on the housing 4 during the manufacture of the exchanger 1 and in particular before and during the brazing of its various constituent components.

Figure 9:
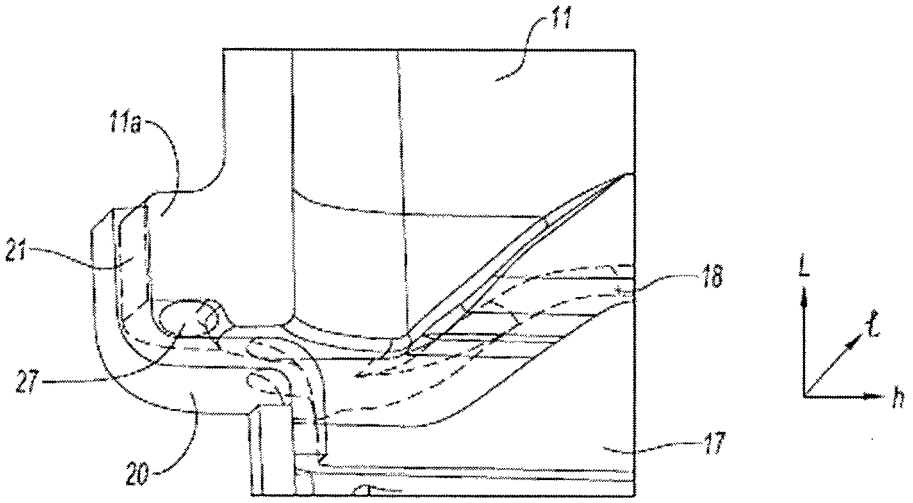
FIG. 9 shows a perspective cross sectional view, partially from the back of a corner of the exchanger in FIG. 1.
Figure 10:
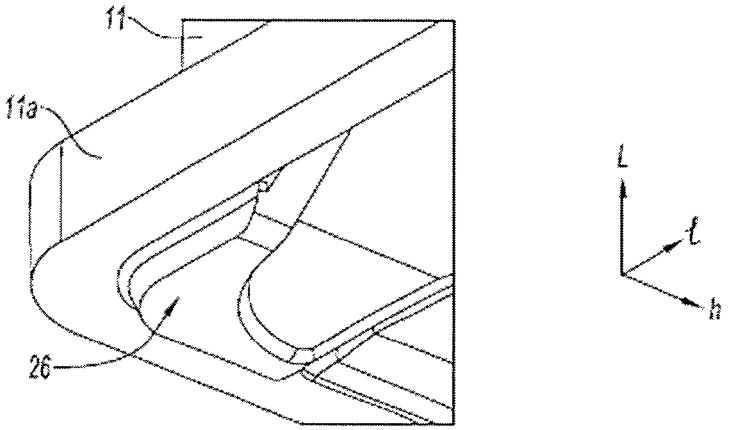
FIG. 10 shows a perspective view, from above, of a corner of the collecting tank of the exchanger in FIG. 1.
Figure 11:
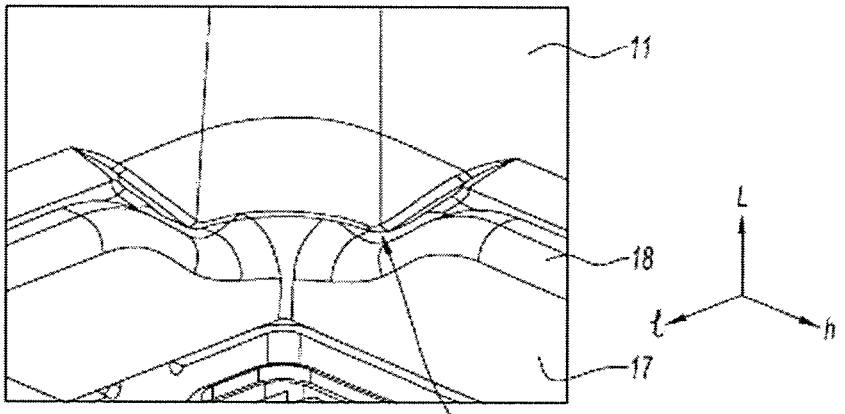
FIG. 11 shows a perspective view, from the inside, of a corner of the exchanger in FIG. 1.

The manufacture of the exchanger 1 is made easier in this way. The tubes 2 are stacked and inserted into the openings of the collectors 10 and the L-shaped walls 15, 16 of the housing 4 placed around them and held in position one with respect to another thanks to the crimping lugs R; it can be noted here that other holding means such as clinching means could be provided. The flanges 5 are moved to the ends of the housing 4, the locating lugs 24 being inserted into the openings 23 provided for this purpose and deformed, bent over or crimped to ensure the holding of the assembly. Everything can then be brazed and is placed in a furnace for this purpose, in a known manner. The areas intended to be brazed to the housing 4 (and notably the outside areas of the skirts 10*a* of the collectors 10 and the areas of the grooves G1) have consistent dimensions, which allows for quality brazing, the contact areas being large. The input 11 and output collecting tanks 11' can then be crimped to the exchanger 1, in this particular case whilst arranging a seal ring 27 in the bottom of the groove G2 receiving the fixing edge 11*a* of the tank 11, in a known manner; this is an O-ring 27 which is shown schematically in FIGS. 3 and 9.

One particular characteristic of the exchanger 1 can be seen in FIGS. 3, 5, 6 and 8 to 11: the corners of the flange 5 include a pushed-in portion 25 at the internal groove G1.

Such a pushed-in portion 25 is provided for facilitating the manufacture of the flange 5 and for promoting the quality of its brazing on the housing 4, by ensuring a sufficient brazing area including in the corners. Indeed, the flange 5, in this particular case, is formed by chasing and it is difficult to bend the material in the corners, as is known. Thus, thanks to the pushed-in portions 25, the quantity of material in the corners is less great, which allows them to be chased in such a way so as to form an internal longitudinal wall which has, including in the corners, sufficient length to enable quality brazing to the housing 4.

Obviously, the shape of the housing, and more particularly the shape of the corners of the ends of the housing 4, is adapted to the shape of the flange 5, as can be seen, for example, in FIG. 5 (the ends of the housing 4 being intended to abut against the internal groove G1 of the flange 5).

The collecting tank 11 includes, at each corner, a swelling 26 corresponding to the pushed-in portion 25 of the flange 5. Said swelling 26 is accommodated in the pushed-in portion 25, ensuring a function of holding the seal ring 27 in position; indeed, the seal ring 27 would not be contained in the corners on account of the pushed-in portions 25 of the flange 5.

Figure 12:
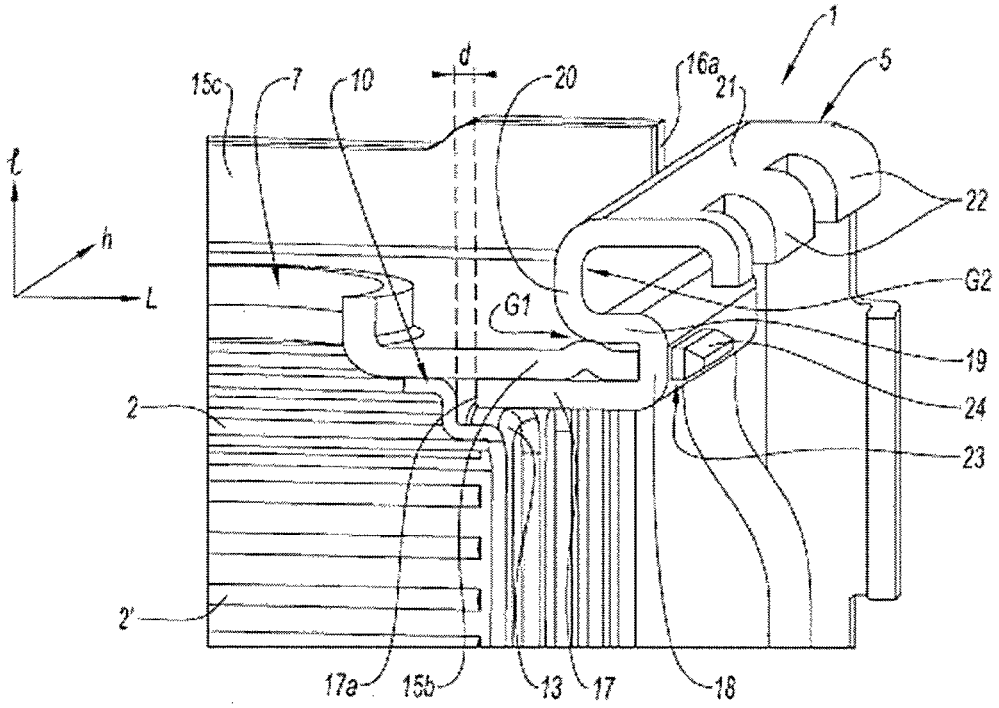
FIG. 12 shows a perspective sectional view in the plane of the length and the width of a second embodiment of the exchanger of the invention.

A second embodiment of the flange 5 of the exchanger 1 can be seen in FIG. 12. Its description will be concise and the references used for the preceding embodiment will be kept, with only the differences between these embodiments being described.

In the second embodiment shown in FIG. 12, the form of the skirt 10*a* of the collector 10 is slightly different: it can be seen that it is not bent over toward the collecting tank 11 as was the case in the first embodiment but is bent over on the other side, in the direction of the other end of the exchanger 1. Whichever way, the collector 10 has an external area of peripheral skirt at which it is brazed to the internal area of the walls of the housing 4, in this particular case at a spacing d from the free end 17*a* of the internal longitudinal wall 17 of the flange 5.

The operation of the exchanger 1 (whatever its embodiment) is as follows (it is described in a concise manner as it is well known by the person skilled in the art). Air is supplied to the air input tank 11, flows in the tubes 2 (said flow being agitated by the fins 2') and leaves the exchanger 1 again by means of the air outlet tank 11'. Furthermore, water is supplied to the exchanger through the water inlet pipe 9, circulates in the water flow ducts 3 (said circulating being agitated by means of the agitators) and leaves the exchanger 1 again by means of the water outlet pipe 8. The flows of air and water are counter-directional in the direction of the length L of the exchanger 1; this is called a "countercurrent" heat exchanger; the efficiency of such an exchanger 1 is very good.

The heat exchanger 1 has been described in connection with air circulating in its tubes 2 and water circulating between the tubes by means of the agitators. It goes without saying that this could be reversed, that is to say water in the tubes and air between the tubes. Furthermore, it could also be air in both cases or water in both cases, or other fluids.

The invention has been described in connection with preferred embodiments, but it goes without saying that other embodiments are conceivable. In particular, the characteristics of the different embodiment described can be combined together, if there are no incompatibilities.

The invention claimed is:

1. A heat exchanger including exchange components and fluid flow components, said exchange components and fluid flow components comprising tubes, and said heat exchanger comprising:

at least one fluid collecting tank into which the exchange components open out; and a housing for accommodating the exchange components and including a plurality of walls forming a volume in which the tubes are received, wherein said heat exchanger includes a flange for fixing the collecting tank to the housing, the flange comprising a peripheral first groove for fixing the housing and a peripheral second groove for fixing the collecting tank, the first and second grooves having a common wall, the first groove for fixing the housing being disposed laterally inwardly of the second groove for fixing the collecting tank such that a part of the flange extends within the housing, the first and second grooves extending along an entire periphery of the housing.

2. The exchanger as claimed in claim 1, comprising at least one collecting plate for holding the exchange components.

3. The exchanger as claimed in claim 2, in which the flange and the collecting plate are distinct parts fixed to the housing independently of each other.

4. A heat exchanger including exchange components and fluid flow components, comprising:

at least one fluid collecting tank into which the exchange components open out and a housing for accommodating the exchange components, wherein said heat exchanger includes a flange for fixing the collecting tank to the housing, the flange comprising a groove for fixing the housing and a groove for fixing the collecting tank, the grooves having a common wall, and at least one collecting plate for holding the exchange components in which the flange and the collecting plate are distinct parts fixed to the housing independently of each other and in which the flange and the collecting plate do not contact each other.

5. The exchanger as claimed in claim 2 in which the flange and the collecting plate are fixed directly to the housing.

6. The exchanger as claimed in claim 1, wherein the collecting tank and the flange are crimped to each other.

7. The exchanger as claimed in claim 1, wherein the flange is brazed to the housing and the housing includes at least one locating lug designed to be accommodated in an opening in the flange to hold this latter on the housing whilst both parts are being brazed.

8. The exchanger as claimed in claim 7, in which an orifice is formed in the bottom of the groove for fixing the housing.

9. The exchanger as claimed in claim 5 in which the collecting plate includes a skirt with an area along which the collecting plate is brazed to the housing.

* * * * *